United States Patent [19]

Conner

[11] Patent Number: 4,850,159

[45] Date of Patent: Jul. 25, 1989

[54] COLLAPSIBLE SEATING SYSTEM WITH AUTOMATICALLY FOLDING SEATS

[75] Inventor: John P. Conner, Grandville, Mich.

[73] Assignee: Irwin Seating Company, Grand Rapids, Mich.

[21] Appl. No.: 6,630

[22] Filed: Jan. 23, 1987

Related U.S. Application Data

[63] Continuation of Ser. No. 765,710, Aug. 14, 1985, abandoned.

[51] Int. Cl.[4] ..... E04H 3/12

[52] U.S. Cl. ..... 52/9; 297/331; 297/378

[58] Field of Search ..... 52/9, 8, 10; 297/331, 297/334, 330, 378, 379

[56] References Cited

U.S. PATENT DOCUMENTS

| | | | |
|---|---|---|---|
| 838,016 | 12/1906 | Flugan, Sr. | 52/10 |
| 895,552 | 8/1908 | Gehrke . | |
| 1,130,021 | 3/1915 | Roth . | |
| 1,238,087 | 8/1917 | Bawtinhimer . | |
| 1,743,802 | 1/1930 | Andress . | |
| 2,877,507 | 3/1959 | Walworth | 52/10 |
| 3,025,106 | 3/1962 | Evans . | |
| 3,111,344 | 11/1963 | Hoven . | |
| 3,134,627 | 5/1964 | Mason . | |
| 3,170,199 | 2/1965 | Martin . | |
| 3,194,601 | 7/1965 | Hoven . | |
| 3,316,014 | 4/1967 | Barecki . | |
| 3,351,377 | 11/1967 | Anderson . | |
| 3,410,600 | 11/1968 | Thorpe . | |
| 3,443,835 | 5/1969 | Brunskole . | |
| 3,703,312 | 11/1972 | Chapman . | |
| 3,762,765 | 10/1973 | Piretti . | |
| 4,000,586 | 1/1977 | Vance . | |
| 4,063,392 | 12/1977 | Van Ryan . | |
| 4,082,353 | 4/1978 | Hollowell | 297/379 |
| 4,105,245 | 8/1978 | Simons . | |
| 4,155,202 | 5/1979 | Hartman . | |
| 4,189,876 | 2/1980 | Crossman . | |
| 4,195,451 | 4/1980 | Jarvis . | |
| 4,211,450 | 7/1980 | Sutter . | |
| 4,294,048 | 10/1981 | Sutter . | |
| 4,446,659 | 5/1984 | Quigley . | |
| 4,557,080 | 12/1985 | Walworth et al. | 52/9 |

FOREIGN PATENT DOCUMENTS

| | | |
|---|---|---|
| 2529769 | 1/1984 | France . |
| 380932 | 10/1964 | Switzerland . |
| 262140 | 6/1928 | United Kingdom . |

*Primary Examiner*—Michael Safavi

*Attorney, Agent, or Firm*—Price, Heneveld, Cooper, DeWitt & Litton

[57] ABSTRACT

Seating for a telescoping row system or the like is mounted to a beam pivotally secured to a base anchored to the platform and riser. The beam is raised arcuately into a use position by a pneumatic bellows and is mechanically locked in the upright position to permit deenergization of the bellows. Reinflation of the bellows disengages the lock and the assembly collapses slowly against the controlled deflation of the bellows.

The seat is positionable on the beam initially without fasteners to facilitate installation. In similar fashion, armrests are secured to the beam separate from the seat and adjustable along the beam to permit overall width variations.

48 Claims, 4 Drawing Sheets

COLLAPSIBLE SEATING SYSTEM WITH AUTOMATICALLY FOLDING SEATS

This is a continuation of application Ser. No. 765,710, filed Aug. 14, 1985 now abandoned.

BACKGROUND OF THE INVENTION

The present invention relates in general to telescoping seating systems of the type which include a plurality of rows. Each row consists of a riser and platform structure, the rows being mounted on a movable structure so that they are adapted to move between an extended position for use during which the rows are stepped or tiered and a retracted or storage position during which the rows are generally vertically aligned. Seating of this type is often referred to as temporary seating since it is movable into a use position and removed to permit other activity at the seat location.

The present invention relates specifically to the type of telescopic seating system wherein the seats themselves are integrally anchored to the rows and are capable of being automatically folded between a use position and storage position wherein the rows can be retracted with the seats collapsed to permit the vertical alignment described.

Seating systems of the type described are principally utilized in roofed stadia, auditoriums, convention centers and the like wherein significant aspects of concern relate to economic, functional and aesthetic considerations. Cost of procurement, installation and maintenance over the service life are significant concerns. The ability to maintain same in a clean, tidy, attractive condition while deterring or prohibiting vandalism, unintended or prankster manipulation is equally important. The prior art teaches various proposals that attempt to respond to the needs of current industry demands but nonetheless do not accomplish same for varied reasons. Systems which require manual manipulation in one form or another to permit the seat to collapse are not sufficiently tamper-proof to prevent pranksters from undertaking the referenced manipulation. Others propose mechanisms which are either relatively complicated and thereby impractical over the normal service life or provide disadvantages through their arrangements in that they are easily rendered unsightly by the ingress or egress of natural elements or items disposed of by the user such as concessionaire items including dropping of food items and the like. Others yet do not provide the comfort desired or minimization of profile in the seat in its collapsed state to maximize the telescoped effect. In many situations, the desirability of chair seating versus bleacher seating is recognized, but the provision of a back interferes with the closing of the rows or the amount of time required in setting up or knocking down the seating system requires too much effort and labor intensity.

Prior art systems known to Applicant which are purported to be automatic all require the platform to engage and/or otherwise power the folding and erection of the seats. This requires increased strength and power of the system itself to actuate not only the telescoping, but the seat actuation. Finally, the ability to retrofit an in place seating system with more current state of the art seats has been heretofore complicated by the degree of modification required to the system in order to accommodate the desired seats. Thus, there is a broad based need for an improved seating assembly specifically adapted for a telescoped system.

SUMMARY OF THE INVENTION

In accordance with the present invention, in its preferred form, a beam is pivotally mounted to a base structure by one or more supports, the base being anchored to at least one of the riser or platform. A pneumatic bellows interacts with the pivotally mounted support whereby the beam can be raised to an elevated generally parallel position vis-a-vis the platform but relatively adjacent the riser or rotated forwardly upon deflation of the bellows to a position generally adjacent the platform.

In a preferred aspect of the invention, the beam is tubular and mounted so that in its raised position, one edge of the beam defines the uppermost position with two upper surfaces falling away at a roughly forty-five degree angle to inhibit the collection of dirt and food items or the like on the beam. In another preferred aspect of the invention, the seat includes a pair of spaced vertically extending side supports, the lower ends of which are configurated to form a saddle relationship with the beam. The seat back and bottom are pivotally anchored to the side supports, the overall center of gravity of the seat being such that the seat assembly can be placed on the beam in a freestanding manner to facilitate desired spacing during installation. A novel strap means is provided to secure the seat assembly in place. In a more refined aspect of the invention, the seat back and bottom pivot about spaced axes and the cross-sectional configuration of the seat back and bottom are matched to provide an extremely low profile when the seat is pivoted up into nesting engagement and still permit the installation of cushioning means if desired. The pivotal movement at the back and bottom are later connected to lock the back in position when the seat is occupied and facilitate collapsing when the bottom is urged up.

In yet another preferred aspect of the invention, armrests are provided independent of the seat assembly with vertically depending supports likewise configurated at their lower end to form a saddle engagement with the beam, the center of gravity of the armrest also permitting freestanding placement during installation. Similar clamping means are provided to permanently join the armrest to the beam. The separate mounting of the armrest permits overall width adjustment of the seat on a linear basis.

In yet a further aspect of the invention, a unique locking means is provided whereby when the beam and seat assemblies attached thereto are raised by inflation of the bellows, a latch is cammed into position over a lock pin to absolutely lock the seat assembly into its use position in a tamper-proof manner. The latch means secures and holds the seat assembly in its upright position such that the bellows can be depressurized. Upon repressurization of the bellows, a pawl means engages the latch means to disengage same from the lock pin whereby the beam and seat assembly are urged by the gravitational weight thereof to the collapsed storage position, the seat assembly and beam rotating slowly against the bellows as it deflates.

In yet other aspects of the invention, one bellows means actuates a plurality of interconnected seat assemblies and one portable pneumatic source operates a bank of bellows.

In accordance with the invention, a single operator and pneumatic source is all that is required to run a relatively large system unless the magnitude of the total number of collapsible seats is such that multiple compressed air sources would be preferred. In any event, a single operator is all that is required to raise, lower, retract and/or extend the telescoped seating assembly of the present invention.

Significant savings can be realized by the present invention in that the operation of the telescope function (whether automatic or manual) is completely separate from the seat mechanism. The present invention provides a compact, simplistic facile arrangement synergistically incorporating multiple concepts to provide a system with an extremely long service life which operates in a way to prevent involuntary or undesired manipulation. The linear separation of each seat assembly can be simply arranged by adjusting the armrest width whereby a single width seat assembly can be utilized over a given desired range. The installation of the system permits quick and easy centering of each seat and armrest prior to final fastening in a manner that does not require unnecessary labor. The overall profile and appearance of the seats provides an extremely aesthetically attractive system projecting an exposed surface area which will not collect or attract dirt or other items.

DETAILED DESCRIPTION OF THE PREFERRED EMBODIMENT

Figure 1:
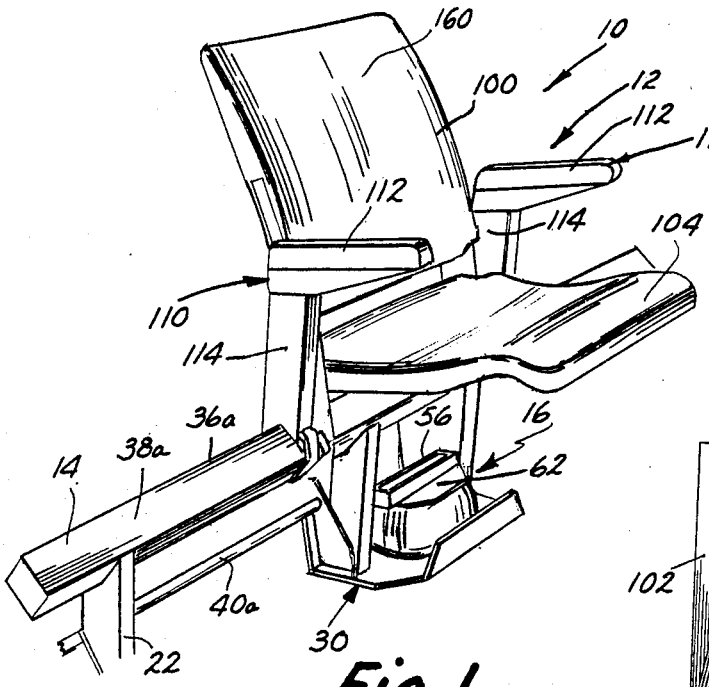
FIG. 1 is a perspective view of the preferred seating assembly in its erected use position with one armrest pivoted up.

A portion of a seating system 10 is depicted in FIG. 1 designed to include three laterally adjacent seat assemblies 12, only one of which is shown in FIG. 1, the other two being identical in configuration and mounted to beam 14 on each side of the seat assembly shown.

The seat assemblies 12 and beam 14 are pivotally supported by a base 16 preferably secured to a platform 18 and associated riser 20 (FIG. 4) which are part of a conventional telescoping system well known to the art.

Figures 4, 5:
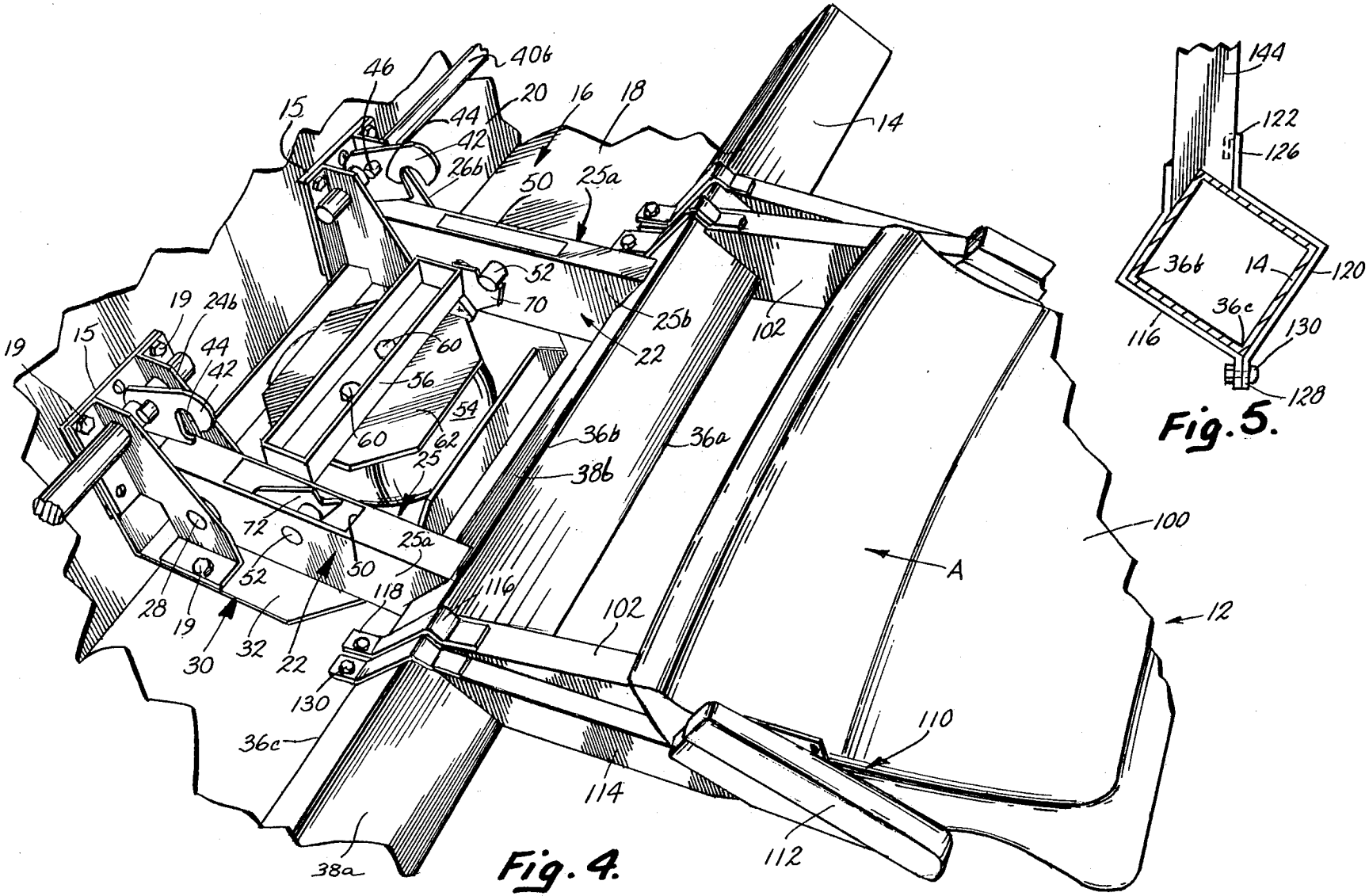
FIG. 4 is a fragmentary perspective view of the seat assembly in its collapsed position.
FIG. 5 is a cross-sectional view of the armrest attachment to the beam taken along line V—V of FIG. 3.
Figure 7:
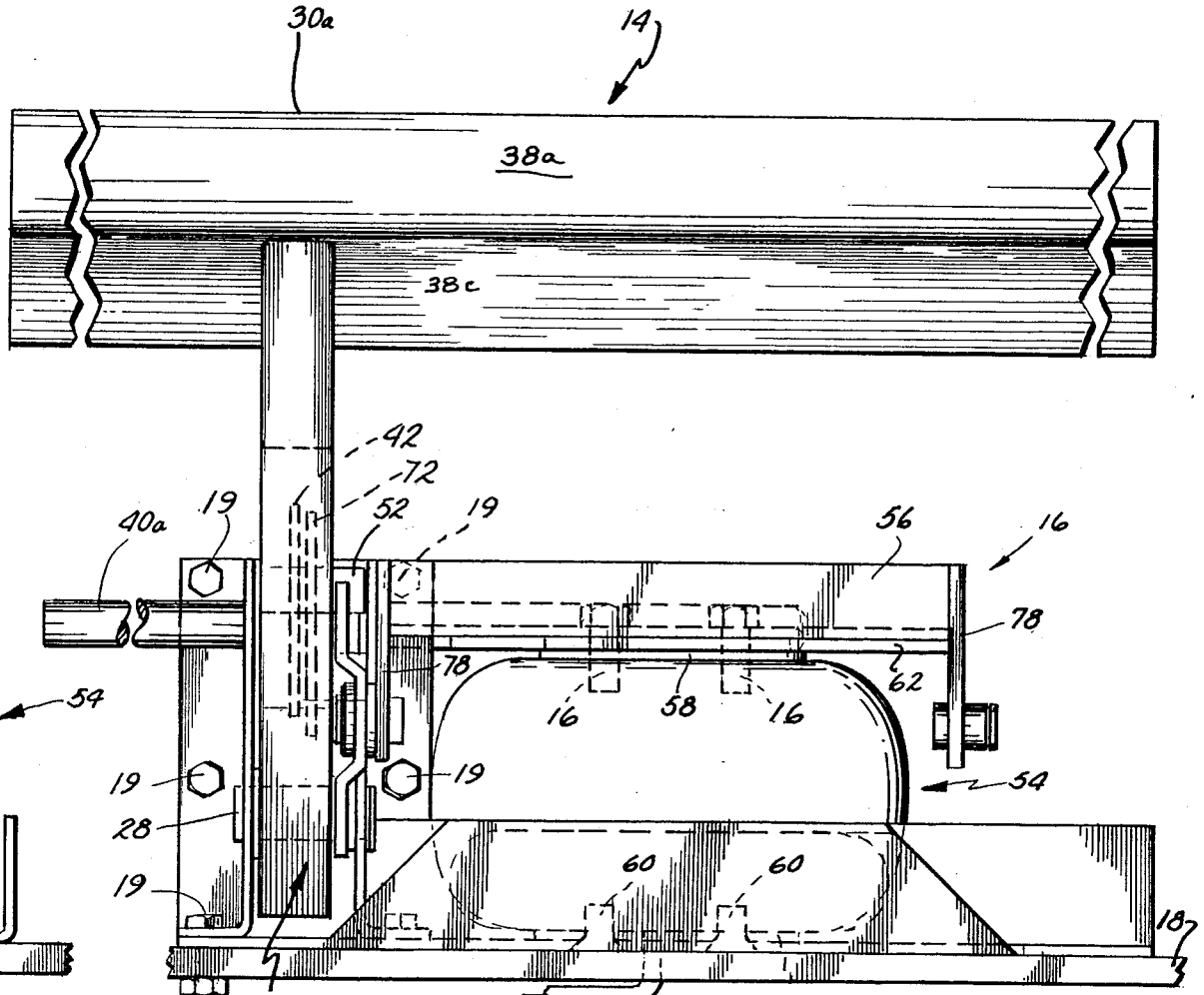
FIG. 7 is a front elevational view thereof partially fragmentized.
Figure 6:
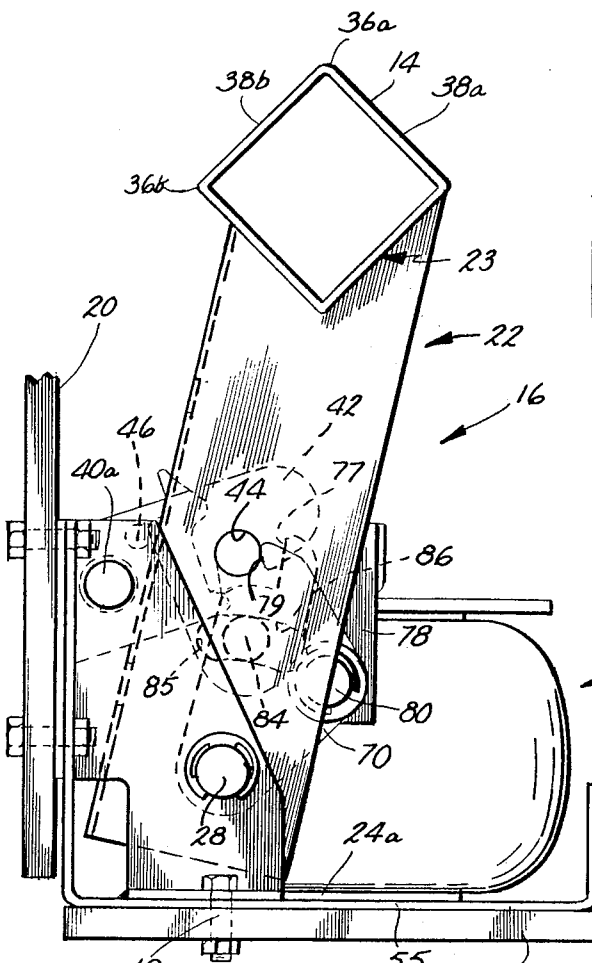
FIG. 6 is a side view of the bellows and latching means of the invention.
Figure 9:
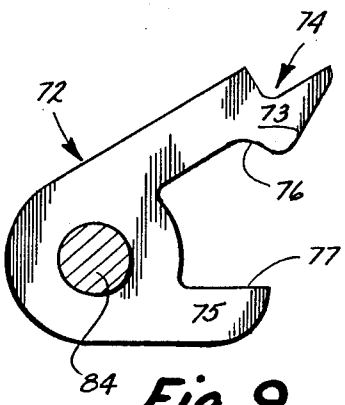
FIG. 9 is a side elevation of the pawl of the invention.

Beam 14 is tubular in configuration and mounted to base 16 by a pair of tubular support arms 22 rotatably secured to base 16 by support plates 24*a*, 24*b* and 26*a*, 26*b* by a pin 28. Plates 24*a*, 24*b*, 26*a*, 26*b* are welded to a base mounting plate 30 which is in turn anchored to platform 18 by bolts 19 secured through a platform portion 32 of the base as depicted in FIGS. 4, 6 and 7. A reinforcement plate 15 is welded to the riser portion 34 of mounting plate 30 which in turn is anchored to riser 20 by bolts 19*a*. In the preferred embodiment wherein three seat assemblies 12 are mounted to beam 14, additional outrigger support arms 22 (FIGS. 1 and 3), are provided to lend lateral stability to the movement of beam 14 as described hereinafter along with the seat assemblies mounted thereon.

Additional paired mounting plates 24 (FIG. 3) are also provided in the same manner described herein with respect to spaced plates 24*a*, 24*b*; 26*a*, 26*b* and associated pins 28. Beam 14 is mounted on support arms 22 on the bias such that its uppermost edge 36*a* forms the top of beam 14 in its raised position (FIGS. 1–3), the upper surface thereof being comprised of sides 38*a*, 38*b* as illustrated in FIG. 6. Conversely when the seat is collapsed into its storage position, beam 14 is rotated into close proximity to or in contact with platform 18 as shown in FIG. 4 and edge 36*b* now becomes the top of beam 14 with sides 38*a*, 38*b* forming the upper surfaces, again. In either position, the collection of dirt or the like on beam 14 will be inhibited and rather fall onto platform 18 for easy cleaning.

Support arms 22 are cut at their upper free end 23 (FIG. 6) in a configuration matching the cross-sectional configuration of beam 14 so that they act as saddles which fit over and seat on the beam in a positive manner. The support arms and beam are permanently joined by a weld, the weld material not being shown in the drawings.

Figure 3:
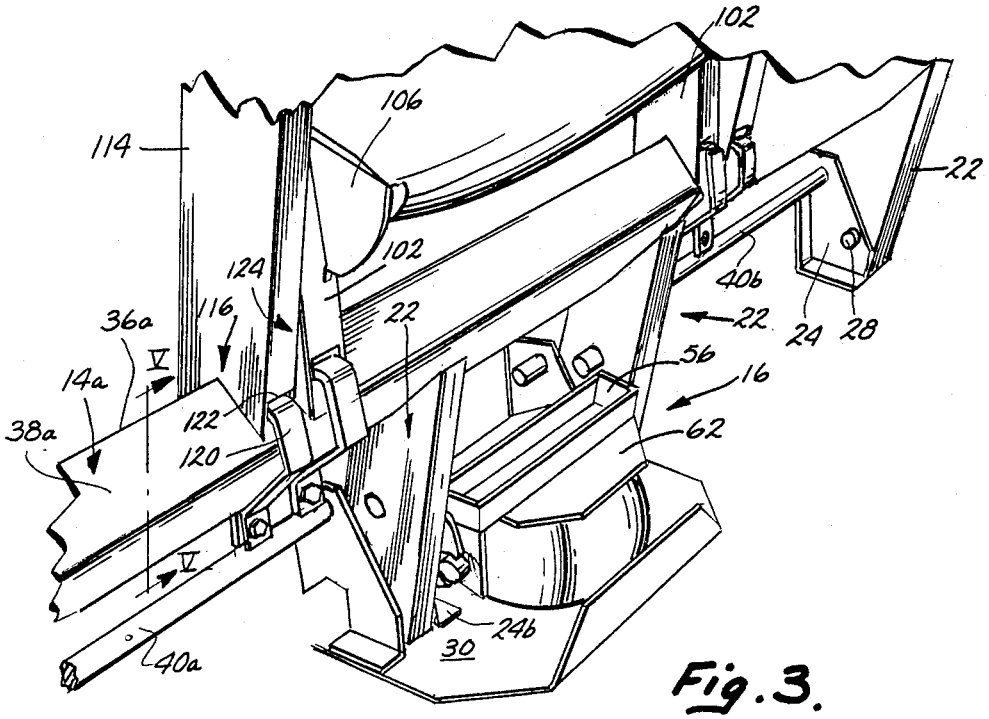
FIG. 3 is a fragmentary perspective view of a single seat assembly in its raised use position with the body support rotated upwardly.

Beam 14 by reason of the pivotal rotation of arms 22 about the axis of pins 28 can be positioned in a raised position wherein the beam is parallel to both the platform 18 and riser 20 spaced from platform 18 but generally adjacent to and in close proximity to riser 20 as depicted in FIG. 3 and in a lowered position as depicted in FIG. 6 wherein beam 14 is still parallel to both platform 18 and riser 20 but generally adjacent to or in contact with platform 18 being spaced from riser 20 approximately the length of support arms 22. The beam thus rotates through about an eighty degree arc as illustrated in FIG. 6.

A latch rod 40*a* is rotatably mounted through each of adjacently paired support plates 24*a*, 24*b* (FIG. 3) and its adjacent outrigger plates 24 of the type shown in FIG. 3 and a second latch rod 40*b* is identically mounted on the opposite side through plates 26*a*, 26*b* and its adjacent outrigger plates 24.

Figure 8:
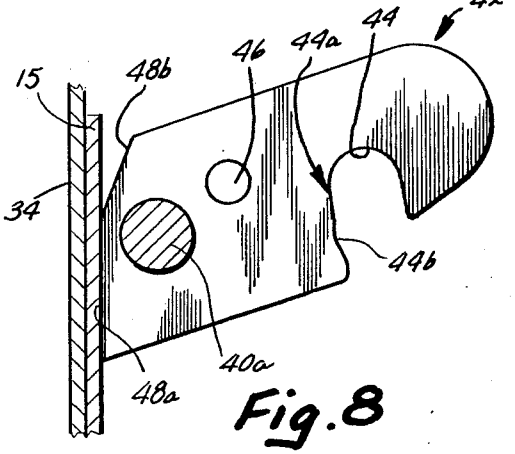
FIG. 8 is a side elevation of the latch plate of the invention.

A latch 42 (FIGS. 4 and 8) is rigidly secured to rods 40*a*, 40*b* between each set of support plates and rotatable therewith. Latches 42 are generally elongated comprising a slot 44 at the free end (FIGS. 4, 6) and an actuating pin 46 projecting from each side thereof forwardly of but in close proximity to rods 40*a* and 40*b*. Slot 44 has reversed curvature portions 44*a*, 44*b* which facilitate latching and unlatching in a manner to be described. Preferably, rods 40*a*, 40*b* are spring biased by a torsion spring (not shown) to urge latch 42 into its downwardmost position whereby stop surface 48*a* abuts the reinforcement plate 15 of base plate 30 as shown in FIGS. 4 and 6, the upwardmost position being defined when stop surface 48*b* abuts plate 15.

Turning to FIGS. 4, 6 and 7, base 16 includes a bellows 54 anchored at its lower surface to the base mounting plate 30. Bellows 54 has a plate 55 (FIG. 7) integral with its lower surface having a surface area approximating the lower surface area of the bellows in its inflated position. The bellows deforms slightly over plate 55 directly onto the base portion 32 of mounting plate 30 in its deflated position. An upper plate 58 identical to plate 55 is likewise provided integral with the bellows. The upper surface of bellows 54 is anchored to a channel-shaped lifting beam or bar 56. An intermediary plate 62 is positioned between beam 56 having an enlarged surface area compared to plate 58 approximating to some extent the upper surface area of the bellows when deflated as shown in FIG. 4. This provides support to bellows 54 during deflation and prohibits abusive distortion. The upper plate 58, intermediary plate 62 and lower plate 55 are anchored by fasteners 60 as shown in FIG. 7. The entire base assembly 16 is anchored to platform 18 by fasteners 19, the only opening required through the platform beneath the bellows being one to permit an appropriate air pressure line 66 to access bellows 54, line 66 extending to an access location in the system (not shown) to permit attachment of the air supply source. Typically, line 66 would be in series with other bellows such that a bank of bellows and associated seats are actuated simultaneously by a single operation using a portable air pump.

Turning to FIG. 4, support arms 22 as mentioned previously are tubular in configuration having an outer free end configuration matching beam 14 to permit facile welded attachment thereto. If one views the seat depicted in FIG. 4 in the direction of "A", support arms 22 have mirrored configurations with respect to the one immediately to the left of bellows 54 and the one on the right side. In each case, there is a rearward access opening 50 which exposes a lock pin 52 secured between the outer sidewall **25*a* and inner sidewall 25*b* extending beyond the outer surface of inner sidewall 25*b*, the latter extension accommodating interaction with a lifting plate 70. A pawl 72 is pivotally anchored within the opening 50 of support arms 22 to a pin 84 (FIG. 6) protruding inwardly through sidewall 25*b* from a lifting plate 70 through an arcuate slot 86 in sidewall 25*b* of arm 22. Pawl 72 is generally "V" shaped, one arm 73 having opposed cam surfaces 74, 76, the other arm 75 having a cam surface 77. Pawl 72 is biased by its weight such that cam surface 76 is urged into contact with pin 52** when the seat assembly is in its collapsed position.

Figure 10:
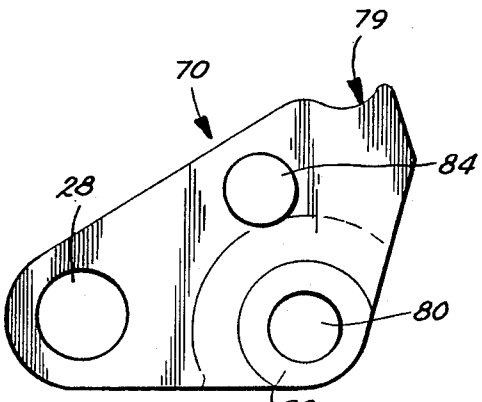
FIG. 10 is a side elevation of the lifting plate of the invention.

The lifting plate 70 has a generally triangular configuration (FIG. 10) and is pivotally mounted to the base assembly about one corner in the same manner as support arms 22 by pins 28. Lifting beam 56 has a pair of downwardly depending side plates 78 (FIG. 7) welded thereto forms a lift frame. A pin 80 is mounted through openings of side plates 78 and anchored to lifting plate 70 about a second corner such that when bellows 54 is inflated or deflated to raise or lower same, lifting plate 70 is likewise lifted and pivoted about the axis of pin 28. A plastic washer 82 is positioned intermediate plates 78 and lifting plate 70 to facilitate relative movement therebetween. As noted earlier, a pin 84 projects from plate 70 through arcuate slot 86 (FIG. 4) in the inner wall **25*b* of arm 22 to which pawl 72 is rotatably mounted. Lifting plate 70 also includes a cam drive surface or pusher 79 at the third corner which engages lock pin 52 when the seat assembly is collapsed. The pawl 72 is preferably mounted intermediate latch 42 and lifting plate 70, sidewall 25*b* of arm 22 being intermediate pawl 72 and lifting plate 70**.

Turning now to FIGS. 4 and 6–10, it will become apparent how the mounting beam 14 and seat assemblies attached thereto are raised, locked, released and lowered. Assuming that the beam 14 is oriented as shown in FIG. 4, bellows 54 being deflated, a source of pressurized air (not shown) is supplied through line 66 to inflate bellows 54. As the bellows are inflated, lifting beam 56 moves vertically up. Due to the pin engagement of its side plates 78 with lifting plate 70, plate 70 is simultaneously lifted and pivoted about the axis of pin 28. As this occurs, arms 22 are rotated upwardly by the direct driving engagement between drive surface 79 and lock pins 52. As the arms pivot upward, lock pin 52 will engage latch 42 in the general vicinity of slot 44 pivoting same upwardly until pin 52 is securely biased against the inwardly radiused slot surface **44*b*. Further movement slides lock pin 52 up to its upper limit position securely engaged within slot 44 of latch 42 as depicted in FIG. 6. The upward movement of lifting plate 70 during this initial inflation of bellows 54 is limited by the contact of pin 84 within slot 86 prior to stop surface 48*b* engaging reinforcement plate 15. During the course of this rotation from the position shown in FIG. 4, as the drive cam 79 moves lock pin 52, pawl 72 is concurrently rotated because of its interconnection to lifting plate 70 by pin 84. However, as it is rotated in the counterclockwise direction from the viewpoint of FIG. 6, the stop surface 77 engages pin 52 because of the configuration of pawl 72. Since arm 75 and stop surface 77 are prohibited from further counterclockwise rotation other than concurrent movement with lifting plate 70, the pawl arm 73 slides ever so smoothly within the spacing between latch pin 46 and lock pin 52. This spacing diminishes and rotates relatively as the arms 22 are raised. The spacing is such that the cam surface 74 will not engage latch pin 46 during the erection of the seat assembly. The final position of pawl 72 in the raised position is depicted in FIG. 6**.

Once latch plate 42 has locked firmly over lock pin 52, the beam 14 and seats mounted thereto are completely locked into their raised upright position. At this juncture, the seating system could be used without fear of manipulation or collapse. There is no meaningful access to release latch 42. At this stage, the source of pressurized air to bellows 54 is preferably removed and the bellows will collapse slowly by its own weight allowing lifting plate 70 to rotate in a clockwise direction with the concurrent clockwise rotation of pawl 72 completely disengaged from lock pin 52. This movement is permitted by the arcuate slot 86 in support arm 22. As a result of this rotation, and the bias of pawl 72, the cam surface 74 will fall into place beneath latch pin 46.

The downward rotation of pawl 72 and lifting plate 70 is limited by pin 84 engaging the end 85 of slot 86. This stop preferably occurs at a position wherein bellows 54 is slightly bulged from its normal deflated position to keep an element of tension on the system so that the beam and seat assemblies will not and cannot rock or be moved. In this way there will not be any looseness or rattling during use which could occur if the system were relaxed.

When it is desired to collapse the system once more, bellows 54 is once more pressurized causing cam surface 74 of pawl 72 to lift latch 42 out of locking engagement with lock pin 52. During this movement, the drive cam 79 of lifting plate 70 will remain spaced from and out of contact with lock pin 52 since pawl 72 can move relative plate 70 by reason of pin 84 in arcuate slot 86. The movement of latch 42 will not be large in magnitude as it is limited by the abutment of stop surface **48*b*** coming into contact with reinforcement plate 15. The movement will be sufficient however to allow disengagement of lock pin 52 from slot 44 of latch 42. Once latch plate 42 is rotated upwardly relative lock pin 52, the weight of beam 14 and seats mounted thereon will cause the beam, support arm and seats mounted thereon to be biased toward rotation in a clockwise direction with respect to FIG. 6. This is assured by the overall center of gravity of the seats and the cant of support arms 22 reflected in FIG. 6 wherein they are approximately twelve degrees off the vertical. The assembly will abruptly shift at this point until lock pin 52 rotates into contact with cam drive surface 79 of lifting plate 70. Ideally, this rotation will not exceed a ten degree fall. At this juncture, the entire seating assembly is free to collapse but for the pressurization of bellows 54. If this pressurization source is removed along with an appropriate bleed down opening, the weight of the entire structure will deflate bellows 54 in a smooth steady manner such that the seating assembly settles slowly into the position depicted in FIG. 4. At this point, the system can be telescoped into a storage position by conventional means.

Particular reference is directed to the unique configuration of slot 44 in assisting the operation of latch 42 both in the locking and unlocking phase. If this surface were straight, the lock pin 52 would have to be driven into the slot past the center point to assure positive locking. Likewise, to disengage latch 42, the movement of latch 42 during unlocking by reason of the force generated from pawl 72 on pin 46 would require some movement of the system at large to permit release below the center point of slot 44 to permit disengagement. The reverse curvature solves this since as the lock pin 52 is initially driven into the recessed area defined by surface **44*b*, removal of the driving force from that point on would still result in complete latching because of the bias of latch 42 and the fact that further movement of latch 42 into the downward locking position results in an internal cam outward by surface 44*a*. Likewise, when pin 46 drives latch 42 upwardly, the reverse curvature eliminates the need to exert any additional raising force on the system itself. The location and operation of pin 84 in slot 86 by limiting the deflation of bellows 54** during use keeps the system tight thereby avoiding swag or undesired movement of the seats during use.

Turning once more to FIG. 3, it is noted that two separate latch rods **40*a*, 40*b* are provided rather than a single bar through the entire base assembly. A single rod could be utilized, but installation is facilitated by using two since it only requires the rod be aligned with two openings, namely, the inner support plates 24*a*, 24*b* and its associated outrigger, the second rod 40*b* requiring alignment only with plates 26*a*, 26*b* and its associated outrigger 24**.

As presently conceived, a bank of seven seats are actuated by a single bellows and base. Three seats are mounted to the beam depicted in FIG. 1, only the center seat being shown. Two double seat modules referred to as dummy units are preferably mounted at each end of the three seat unit, each dummy unit having its own spaced support, support arms, beam, latch and latch rod in the manner previously described. By interconnecting the beams and rods, the outer dummy units are equally actuated with the pneumatically operated inner unit. The rods 40 and beams 14 can be joined in a conventional way by an angle iron fastened to the beams and a tube and roll pin connection of the rods (not shown).

Figure 11:
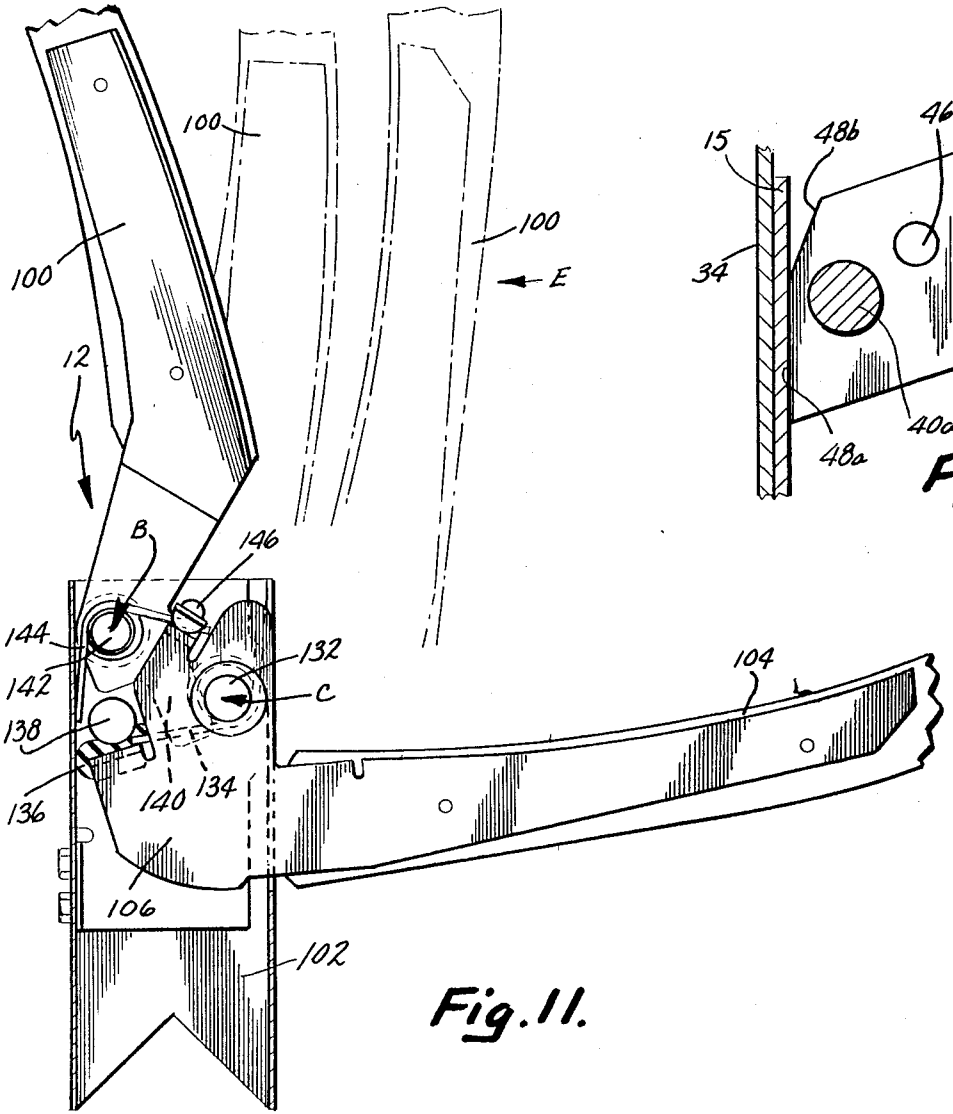
FIG. 11 is a fragmentary side elevation of the seat.

Turning now to FIG. 11, the individual seat 12 encompasses a back support 100 pivotally secured to tubular depending support legs 102 (FIGS. 3 and 4), the latter attaching directly to beam 14. A body support or bottom 104 is pivotally secured to support arms 102 by a pivot plate 106 which hinges directly into and through a slot in legs 102 (FIG. 3). The axis "B" of rotation of back support 100 is spaced from the axis "C" of rotation of body support 104. Body support seat element 104 may be spring biased into a raised position or can be manually rotated into a raised position as well. Armrests 110 (FIG. 2) are mounted to beam 14 independent of seat 12. One advantage of this is to permit no armrests if desired, or, alternatively, depending on the space demand within the installation itself, a single width seat can provide multiple width spacings by simply adjusting the armrest spacing as desired. In normal seating widths, a single seat having a width of eighteen inches can in effect be used to provide seat width variance from eighteen to twenty inches by merely adjusting the armrests. A second seat of twenty inches in width permits normal flexibility for a seat ranging from twenty to twenty-three inches in width by armrest adjustment.

Figure 2:
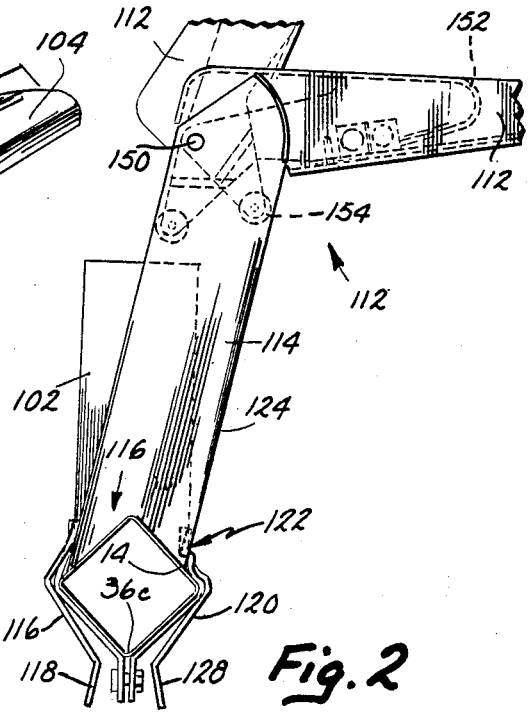
FIG. 2 is a fragmentary side elevation view of one aspect of the seating assembly of the invention.

The arm portion 112 of armrest 110 is pivotally secured to its support tube 114 by a recessed hinge 113. With reference to FIGS. 2–4, the armrest support leg 114 has its lower free end 116 cut angularly to match the configuration of beam 14 forming a saddle-like configuration. With arm 112 rotated up (FIG. 2), the center of gravity of armrest 110 is such that it can be placed on beam 14 during installation without attaching same. This greatly facilitates proper spacing prior to final installation.

To secure armrest 110 to beam 14, a rear strap 116 is welded to the rear surface of support leg 114 and shaped to match the contour of beam 14. At the lower edge **36*c* a vertical tab 118 with an aperture therein is provided. A mating strap 120 is provided with a configuration to fit around the opposite side of beam 14 and a slot 122 is provided in the front face 124 of leg 114 for insertion of a hook 126 formed on the upper end of strap 120. Two different forms of hook 126 are shown in FIGS. 2 and 5. The lower end 128 forms a tab similar to tab 118 with an aligned aperture to permit insertion of a mechanical fastener. The two straps 116 and 120 completely encapsulate beam 14 and permanently secure the armrest assembly to the beam. Quick and easy adjustment can be made however by loosening the fastener 130** or it can be removed entirely with ease.

FIG. 2 illustrates the movement of arm 112 about pin 150 which is biased by spring 152 into either the up or down position indexed by roller 154 against the internal walls of support 114.

Each seat 12 is also mounted to beam 14 in a manner similar to the armrest assembly. With the body support seat 104 folded up and generally aligned with back support 100, the entire seat can be positioned on beam 14 in that legs 114 are likewise configurated at their bottom end to form a saddle-like configuration to fit over beam 14. With the body support seat raised, the center of gravity of the seat is such that it can rest on beam 14 in freestanding fashion. Welded rear straps and hook mounted forward straps are provided identical to that described with respect to armrest 110. This provides accurate and easy installation, adjustment and/or removal in the manner described.

Turning to FIG. 11, both the back support 100 and body support 104 are pivotally attached to supports 102 about spaced axes "B" and "C" and interactive such that when body support 104 is pulled down or someone sits on it, the back 100 is biased to and locked in its most upright position. Upon raising support 104, the linkage rotates the back 100 into a juxtaposed alignment creating a relatively thin or low cross-sectional profile enhanced by the configuration of the seat support 104 and seat back 100. This close juxtaposition is also enhanced by the fact that the axes of rotation of support 104 and back 100 are displaced.

Seat bottom 104 includes a pivot plate 106 anchored therein and extending into support 102 being pivotally mounted therein by pin 132. A leaf spring 134 biases the seat up as shown in phantom position "E" by interacting on plate 106 as shown. A rubber stop 136 engages stop 138 to position support 104 in its use position when the support 104 is rotated by a force sufficient to overcome spring 134 such as a person using the seat.

Back support 100 also has a pivot plate 140 anchored therein and extending out of the support 100 into tube 102 and pivotally anchored about pin 142. A leaf spring 144 biases the back into its use position defined by rubber bumper 146 on plate 140. When body support 104 is positioned in its use position as depicted in FIG. 2, plate 120 includes a portion 123 which engages bumper 136 preventing rotation of back support 100. Once support 104 rotates up, back 100 is free to move to the phantom position E. As the seat rotates, the weight of both back 100 and bottom 104 will overcome springs 134 and 144 and fold together. The displacement of the axes "B" and "C" of pins 142 and 132 permit a very close essentially parallel juxtaposition as shown in FIG. 4.

The configuration of back 100 is characterized by recess portions 160 and 162 (FIG. 1) which are contoured to provide not only comfort to the user, but to overlap in the collapsed state with the contour of bottom 104 so that the cross-sectional width of the profile of the folded units is minimized. Indeed, it has been found that whether the seat portions are comprised of wood or plastic, the overall cross-sectional width can be reduced to five inches and one-half and yet permit up to three inches of cushioning material to be attached thereto without causing an increase in the cross-sectional profile during the collapsed position. Finally, a metallic or plastic cover (not shown) is provided to fit over base 16 cooperating with the configuration of the support plate 30 to prevent accidental or unwarranted ingress.

Having thus disclosed in detail a preferred embodiment of the invention, persons skilled in the art will be able to modify certain of the structure which has been illustrated and to substitute equivalent elements for those disclosed while continuing to practice the principle of the invention; and it is, therefore, intended that all such modifications and substitutions be covered as they are embraced within the spirit and scope of the appended claims.

I claim:

1. In a collapsible seating system with automatically folding seats having a plurality of stepped rows comprising generally vertical risers and vertically spaced horizontal platforms movable between an extended position in which the platforms are in stepped relation and a contracted position in which said platforms are generally vertically aligned, the height of said spacing corresponding generally to the height of said risers, and drive means for mechanically moving said risers and platforms between said positions, the combination comprising:

a collapsible seat mounted to one of said platform and riser in a row, said seat being collapsible between a lowered position wherein said seat is lying down in a folded position in juxtaposition with said platform, said seat having a cross-sectional height less than said platform spacing in said lowered position to permit at least part of said seat to be positioned between said platform and the platform thereabove in a generally nested storage position, and a raised position wherein said seat is raised for use; and pneumatically operating lift means operatively engaged and associated with said seat to raise and lower same, said lift means being independently operative from said drive means, said seat being mechanically movable between said positions by said lift means when said platform is in said extended position independent of any interacting contact with an adjacent riser, platform or seat mounted thereon to cause said seat to move.

2. The apparatus of claim 1 wherein said pneumatic means is a bellows which is inflated to raise said seat and deflated to lower same.

3. The apparatus of claim 2 wherein said seat includes lock means which mechanically locks said seat into said raised position permitting the pressure in said bellows to be released while said seat is used.

4. The apparatus of claim 3 wherein said lock means is not subject to manual release, but is automatically released by reinflation of said bellows, said seat being lowered as said bellows is deflated.

5. The apparatus of claim 1 further comprising a base mounted within a row to at least one of said riser and platform of said row, a beam pivotally mounted to said base generally parallel to said platform and riser, said beam having a cross-sectional configuration defining a top, said pneumatic means being interconnected to said beam to raise and lower same arcuately between said positions wherein said beam is displaced vertically from said platform in general proximity of said riser in said raised position and displaced horizontally from said riser in general proximity of said platform in said lowered position, said seat mounted to said beam and movable therewith.

6. The apparatus of claim 5 wherein said beam is connected to said base by at least one support arm, said arm having a pair of opposing ends, the length of said arm generally defining the distance in which said beam is vertically or horizontally displaced.

7. The apparatus of claim 6 wherein said arm is pivotally connected at one end to said base about an axis parallel to said platform and rigidly connected to said seat at the opposite end of said arm.

8. The apparatus of claim 5 wherein the length of said beam is sized to permit a plurality of seats to be mounted thereto in side-by-side relationship whereby a plurality of seats are movable between said positions by a single pneumatic means.

9. The apparatus of claim 5 wherein said system further includes a second base mounted in spaced relationship to and adjacent said first base, a second beam pivotally mounted to said second base and supporting one or more additional seats, said second beam being interconnected to said first beam and movable therewith whereby a plurality of seats are movable between said positions by a single pneumatic means.

10. The apparatus of claim 5 wherein said pneumatic means is a bellows which is inflated to raise said beam and deflated to lower same.

11. The apparatus of claim 10 wherein said seat includes lock means which lock said seat into said raised position whereby the pressure in said bellows can be released while said seat is used.

12. The apparatus of claim 11 wherein said lock is not subject to manual release, but is automatically released by reinflation of said bellows, said seat being lowered as the bellows is deflated.

13. The apparatus of claim 5 wherein said seat includes a vertical support having an upper and lower end, the lower end of said support having a configuration which matches at least in part, the cross-sectional configuration of said beam such that said support is positioned over said beam in saddle-like fashion.

14. The apparatus of claim 13 wherein the center of gravity of said seat permits said seat to rest on said beam independent of the need for additional fastener means during installation.

15. The apparatus of claim 14 wherein said beam is tubular with a rectangular cross-sectional configuration and mounted to said base such that the top of said beam is defined by an edge and two sloped surfaces to inhibit the collection of dirt or articles on said beam.

16. The apparatus of claim 15 wherein the configuration of the lower end of said support is an inverted "V" which matches the configuration of the top of said beam.

17. The apparatus of claim 14 wherein fastener means rigidly secure said seat to said beam for use.

18. The apparatus of claim 13 wherein said seat includes a back and bottom pivotally secured to said support and interconnected whereby said back and bottom fold together when said seat is in said lowered position.

19. The apparatus of claim 18 wherein said back is locked in an upright position when said seat is occupied.

20. The apparatus of claim 18 wherein said back and bottom pivot about spaced axes to enhance a low cross-sectional profile of said seat in said lowered position.

21. The apparatus of claim 18 wherein the configuration of said seat back and bottom cooperate to enhance a low cross-sectional profile of said seat in said lowered position.

22. The apparatus of claim 5 further including armrests on each side of said seat, said armrests being mounted on said beam independent of said seat and adjustable along said beam relative said seat.

23. The apparatus of claim 22 wherein each of said armrests includes a generally vertical portion having an upper and lower end, said arm being pivotally secured to said upper end.

24. The apparatus of claim 23 wherein the lower end of said vertical portion has a configuration which matches at least in part, the cross-sectional configuration of said beam such that said vertical portion is positioned over said beam in saddle-like fashion.

25. The apparatus of claim 24 wherein the center of gravity of said armrest permits said armrest to rest on said beam independent of the need for additional fastener means during installation.

26. The apparatus of claim 25 wherein said beam has a tubular cross-sectional configuration defining a top edge, a pair of top sides sloping outwardly away from each other forming a generally inverted "V" shape and a pair of bottom sides joined to said top sides and sloping inwardly toward each other and being joined together to define a bottom edge of said beam, the joinder of said top and bottom sides forming opposed side edges the configuration of the lower end of said vertical portion of said armrest being in the shape of an inverted "V" which matches the configuration of the top of said beam.

27. The apparatus of claim 26 wherein fastener means rigidly secure the armrests to the beam for use.

28. The apparatus of claim 4 wherein the gravitational weight of said seat acts upon said seat to lower said seat at a controlled rate, said bellows having a preselected air discharge rate based on the gravitational weight of said seats.

29. The apparatus of claim 12 wherein the gravitational weight of said seat acts upon said seat to lower said seat at a controlled rate, said bellows having a preselected air discharge rate based on the gravitational weight of said seats.

30. In a collapsible seating system with automatically folding seats having a plurality of stepped rows comprising generally vertical risers and horizontal platforms movable between an extended position in which the platforms are in stepped relation and a contracted position in which said platforms are generally vertically aligned, the combination comprising:

a base mounted within a row to at least one of said riser and platform of said row, a beam pivotally mounted to said base generally parallel to said platform and riser, said beam having a cross-sectional configuration defining a top;

a collapsible seat mounted to said beam, said seat having a center of gravitational weight, said seat being collapsible between a lowered positioned wherein said seat is lying down in a folded position in juxtaposition with said platform, said seat having a cross-sectional height less than said platform spacing in said lowered position to permit at least part of said seat to be positioned between said platform and the platform thereabove in a generally nested storage position, and a raised position wherein said seat is raised for use;

lift means including pneumatic means operatively engaged with said beam to raise and lower same, said pneumatic means being interconnected to said beam to raise and lower same accurately between said positions wherein said beam is displaced vertically from said platform in generally proximity of said riser in said raised position and displaced horizontally from said riser in general proximity of said platform in said lowered position, said seat mounted to said beam and movable therewith;

said seat includes a vertical support having an upper and lower end, the lower end of said support having a configuration which matches, at least in part, the cross section configuration of said beam such that said support is positioned over said beam in saddle-like fashion, the center of gravity of said seat being located such that said seat rests on said beam independent of the need for additional fastener means during installation; and fastener means rigidly securing said seat to said beam for use, wherein said fastener means include a pair of straps attached to said support, at least one of said straps being detachable from said support, said straps when connected to each other encapsulating said beam.

31. In a collapsible seating system with automatically folding seats having a plurality of stepped rows comprising generally vertical risers and horizontal platforms movable by drive means between an extended position in which the platforms are in stepped relation an a contracted position in which said platforms are generally vertically aligned, the combination comprising:

a support base mounted within each row to at least one of said riser and platform of each row, a support beam pivotally mounted to each base generally parallel to said platform and riser, said beam having a tubular cross-sectional configuration defining a top edge, a pair of top sides sloping outwardly away from each other forming a generally inverted "V" shape and a pair of bottom sides joined to said top sides and sloping inwardly toward each other and being joined together to define a bottom edge of said beam, the joinder of said top and bottom sides forming opposed side edges;

a collapsible seat mounted to said beam and movable with said beam between a lowered position wherein said seat is lying down in a folded position in juxtaposition with said platform, said seat having a cross-sectional height less than said platform spacing in said lowered position to permit at least part of said seat to be positioned between said platform and the platform thereabove in a generally nested storage position, and a raised position wherein said seat is raised for use;

pneumatic lift means operatively engaged with said beam to pivotally raise and lower said beam and seat arcuately between said positions wherein said beam is displaced vertically from said platform in general proximity of said riser in said raised position and displaced horizontally from said riser in general proximity of said platform in said lowered position;

collapsible armrests positionable on each side of said seat, said armrests being mounted on said beam independently adjustable along said beam relative said seat, said armrests including a generally vertical portion to which the arm is pivotally secured, said vertical portion having a lower end, the lower end of said vertical portion having a cross-sectional configuration defining an inverted "V" shape corresponding to the top of said beam such that said vertical portion is positioned over said beam in saddle-like fashion, the center of gravity of said armrest being located such that said armrest rests on said beam independent of the need for additional fastener means during installation; and fastener means rigidly securing the armrests to the beam for use, said fastener means including a pair of straps attached to said vertical portion of said arm rest; at least one of said straps being detachable from said vertical portion, said straps when connected to each other encapsulating said beam.

32. In a collapsible seating system with automatically folding seats having a plurality of stepped rows comprising generally vertical risers and horizontal platforms movable between an extended position in which the platforms are in stepped relation and a contracted position in which said platforms are generally vertically aligned, the combination comprising:

a base mounted within a row to at least one of said riser and platform of said row, a beam pivotally mounted to said base generally parallel to said platform and riser, said beam having a cross-sectional configuration defining a top;

a collapsible seat mounted to said beam, said seat being collapsible between a lowered position wherein said seat is lying down in a folded position in juxtaposition with said platform, said seat having a cross-sectional height less than said platform spacing in said lowered position to permit at least part of said seat to be positioned between said platform and the platform thereabove in a generally nested storage position, and a raised position wherein said seat is raised for use;

lift means including pneumatic means operatively engaged with said beam to raise and lower same, said pneumatic means being interconnected to said beam to raise and lower same arcuately between said positions wherein said beam is displaced vertically from said platform in general proximity to said riser in said raised position and displaced horizontally from said riser inn general proximity of said platform in said lowered position, said seat mounted to said beam and movable therewith;

said beam being connected to said base by at least one support arm, the height of said arm generally defining the said deplacement, the arm being pivotally connected at one end to said base about an axis parallel to said platform and rigidly connected to said seat at its opposite end;

said pneumatic means being secured to said platform within said base, said lifting means further comprising:

a frame secured to and movable vertically with said pneumatic means, a lifting plate pivotally anchored to said base about a first axis, a first pin interconnecting said frame and plate, said pin being fixed relative said frame and rotatable relative said plate whereby vertical movement of said frame rotates said plate about said first axis, said plate including a pusher, and said arm having a second pin projecting laterally toward said frame, said pneumatic means when raised causing said pusher to act against said second pin to raise said beam and seat.

33. The apparatus of claim 32 wherein lock means are provided to lock said seat and beam in said raised position, said lock means includes a latch pivotally mounted to said base and engageable with said second pin wherein said beam is raised to lock said beam into said raised position.

34. The apparatus of claim 33 wherein said latch includes a third pin projecting from at least one side thereof, said lock means further including a pawl pivotally mounted to said arm and movable therewith, said pawl being movable by said arm into sliding engagement with said third pin when said beam is raised and positionable into engagement therewith upon deenergizing said pneumatic means to lock said arms in said raised position whereby further energization of said pneumatic means causes said pawl to act against said third pin and lift said latch out of locking engagement with said second pin to permit lowering of said arm and attached seats.

35. The apparatus of claim 34 wherein said system further includes a second base mounted in spaced relationship to and adjacent said first base, a second beam pivotally mounted to said second base and supporting one or more additional seats, said second beam being interconnected to said first beam and movable therewith; said second base including a corresponding lifting plate, pawl, and latch, said corresponding latch being interconnected to said latch of said first base whereby a plurality of seats are movable between said positions by a single pneumatic means into and out of locking engagement.

36. The apparatus of claim 35 wherein said pneumatic means is a bellows anchored to said base, said base being anchored to both said platform and riser.

37. In a collapsible seating system with automatically folding seats having a plurality of stepped rows comprising generally vertically risers and horizontal platforms movable between an extended position in which the platforms are in stepped relation and a contracted position in which said platforms are generally vertically aligned, and drive means for mechanically moving said risers and platforms between said positions, the combination comprising:

a base anchored to one of said platform and riser, said base having opposed sides;

a pivotal seat support frame anchored to said base and comprising spaced support arms rotatably secured to said base at one end and rigidly attached to a beam at the other end whereby said beam is parallel to said platform and riser and movable from a raised position generally adjacent to said riser to a lowered position in juxtaposition with said platform;

a seat fixed to said beam above said base comprising spaced sides attached to said beam and a seat back and bottom rotatably secured between said sides and movable to form said seat when said beam is raised and to fold in juxtaposition when said beam is lowered;

lift means operable between an activated and deactivated condition, said lift means, when deactivated, providing no lifting forces upon said beam and seat, said lift means, when first activated, mechanically lifts said beam and seat into said raised position, said lift means being independently operative of said drive means and operable independent of any physical interaction with an adjacent platform, riser or seat mounted thereon whereby said seat is movable by said lift means from said lowered position to said raised position when said platform is in said extended position independent of the movement of said platforms and risers;

lock means cooperating with said lift means to mechanically lock said seat in said raised position and mechanically support said seat in said raised position to allow said lift means to be deactivated a first time while said seat is in use;

pawl means which disengage said lock means when said lift means are reactivated a second time the center of gravity of said beam and seat being located such that said beam and seat will lower upon deactivation of said lifting means a second time and said seat will concurrently collapse into a folded position independent of the movement of or interaction with any adjacent platform, riser or seat; and said lift means comprising a pneumatic bellows having a preselected air discharge rate based on the gravitational weight of said seat whereby when said lift means is deactivated a second time, said seat is lowered at a controlled rate by the gravitational weight of the seat acting against the preselected air discharge rate of the bellows.

38. A seating system comprising, in combination, a base, multiple seats adjustably mounted on said base in side-by-side fashion, said base including a seat support beam extending longitudinally and generally spaced from and parallel to the floor, said beam having a tubular cross-sectional configuration defining a top edge, a pair of top sides sloping outwardly away from each other forming a generally inverted "V" shape and a pair of bottom sides joined to said top sides and sloping inwardly toward each other and being joined together to define a bottom edge of said beam, the joinder of said top and bottom sides forming opposed side edges, each of said seats including a vertical support for attachment to said beam, said support having an upper and lower end, the lower end of said support having a configuration which forms an inverted "V" cross-section which corresponds at least in part to the cross-sectional configuration of the upper part of said beam such that said support is positioned over said beam in saddle-like fashion, the center of gravity of said seat permitting said seat to sit freely on said beam during installation, and fastener means rigidly securing said seats to said beam for use, wherein said fastener means include a pair of straps attached to said support, at least one of said straps being detachable from said support, said straps when connected to each other conforming to the cross-sectional configuration of said beam and encapsulating same.

39. A seating system comprising, in combination, a base, multiple seats adjustably mounted on said base in side-by-side fashion, said bases including a seat support beam extending longitudinally and generally spaced from and parallel to the floor, said beam having a tubular cross-sectional configuration defining a top edge, a pair of top sides sloping outwardly away from each other forming a generally inverted "V" shape and a pair of bottom sides joined to said top sides and sloping inwardly toward each other and being joined together to define a bottom edge of said beam, the joinder of said top and bottom sides forming opposed side edges, each of said seats including a vertical support for attachment to said beam, the lower end of said support having a configuration which forms an inverted "V" cross-section which corresponds at least in part to the cross-sectional configuration of the upper part of said beam such that said support is positioned over said beam in saddle-like fashion, the center of gravity of said seat permitting said seat to sit freely on said beam during installation, and fastener means rigidly securing said seats to said beam for use, wherein the fastener means rigidly secures the arm rests to the beam for use, said fastener means including a pair of straps attached to said vertical portion, at least one of said straps being detachable from said vertical portion, said straps when connected to each other conforming to the shape of said beam and encapsulating same.

40. In a collapsible seating system with automatically folding seats having a plurality of stepped rows comprising generally vertical risers and horizontal platforms movable by drive means between an extended position in which the platforms are in stepped relation and a contracted position in which said platforms are generally vertically aligned, the combination comprising:

a base anchored to one of said platform and riser;

a beam pivotally mounted to said base and movable from a raised position generally adjacent to said riser to a lowered position in juxtaposition with said platform;

a plurality of foldable seats fixed to said beam and movable therewith, each of said seats having a back and bottom rotatable about spaced axes between a first position wherein said seat is available for use when said beam is raised and a second position where said back and bottom lie generally parallel and in juxtaposition with each other when said beam is lowered;

pneumatic lifting means which when first actuated lifts said beam and seat into said raised position, said lift means being independently operative from said drive means, said seat being movable independent of any movement or interaction with an adjacent platform, riser or seat mounted thereon, whereby said seat is movable between said positions when said platform is in said extended position independent of the movement of said platforms and risers;

lock means cooperating with said lift means to mechanically lock said seats in said raised position and mechanically support said seat in said raised position to allow said lifting means to be deactivated while said seat is in use; and pawl means which disengage said lock means when said lifting means are reactivated a second time whereby said beam will lower gradually upon deactivation of said lifting means a second time and said seats will concurrently collapse into a folded position.

41. The system according to claim 40 wherein said pneumatic means includes a bellows and wherein said beam and seats collapse gradually at a controlled rate by the gravitational weight of the seats operating against said bellows, said bellows having a preselected air discharge rate based on the gravitational weight of said seats.

42. In a collapsible seating system with automatically folding seats having a plurality of stepped rows comprising generally vertical risers and horizontal platforms movable between an extended position in which the platforms are in stepped relation and a contracted position in which said platforms are generally vertically aligned, the combination comprising:

a base anchored within each row to at least one of said platform and riser associated with each row, a beam pivotally mounted to each base generally parallel to said platforms and risers;

a plurality of collapsible seats mounted side-by-side on said beams, said seats being collapsible between a lowered position wherein said seats are lying down in a folded position in juxtaposition with said associated platform, said seats having a cross-sectional height less than said platform spacing in said lowered position to permit at least part of said seats to be positioned between said platform and the platform thereabove in a generally nested storage position, and a raised position wherein said seat is raised for use;

separate lift means operatively engaged with an interconnected to each of said beams to raise and lower same arcuately between said positions wherein said beams are displaced vertically from said platform in general proximity of said riser in said raised position and displaced horizontally from said riser in general proximity of said platform in said lowered position;

said lift means functioning independent of any means utilized to move said risers and platforms and being capable when activated of lifting said associated beams and seats when said platforms are in said extended position independent of the movement of said risers or platforms, and said beams and seats being capable of folding into said collapsible and lowered position by their gravitational weight when said lift means are deactivated, the movement of said seats being independent of any cooperative interaction of said seats with an adjacent riser, platform or seat mounted thereon said system comprising a plurality of finite groups of seats arranged per row in banks, each bank including separate lift means whereby each group of seats is operable between said positions independent of any other group; and each of said lift means comprising a pneumatic bellows, said seat being lifted into said raised position when said bellows are inflated and capable of being lowered into said lowered position when said bellows are deflated, said system including lock means which lock said beam and seats in said raised position during use and permit said bellows to be deflated during use of said seats.

43. The system of claim 42 wherein a plurality of finite groups of seats are arranged per row in banks, each bank including separate lift means whereby each group of seats is operable between said positions independent of any other group.

44. In a collapsible seating system with automatically folding seats having a plurality of stepped rows comprising generally vertical risers and horizontal platforms movable between an extended position in which the platforms are in stepped relation and a contracted position in which said platforms are generally vertically aligned, and drive means for mechanically moving said risers and platforms between said positions, the combination comprising:

a first base anchored to one of said platform and riser, said first base having opposed sides;

a pivotal seat support frame anchored to said first base and comprising spaced support arms rotatably secured to said base at one end and rigidly attached to a first beam at the other end whereby said first beam is parallel to said platform and riser and movable from a raised position generally adjacent to said riser to a lowered position in juxtaposition with said platform;

a seat fixed to said first beam above said first base comprising spaced sides attached to said first beam and a seat back and bottom rotatably secured between said sides and movable to form said seat when said first beam is raised and to fold in juxtaposition when said first beam is lowered;

pneumatic lifting means which when first actuated mechanically lifts said first beam and seat into said raised position, said lift means being independently operative of said drive means and operable independent of any physical interaction with an adjacent platform, riser or seat mounted thereon whereby said seat is movable by said lifting means into said raised position when said platform is in said extended position independent of the movement of said platforms and risers;

lock means cooperating with said lift means to mechanically lock said seat in said raised position and mechanically support said seat in said raised position to allow said lifting means to be deactivated while said seat is in use;

pawl means which disengage said lock means when said lifting means are reactivated a second time whereby said beam will lower by its own weight upon deactivation of said lifting means a second time and said seat will concurrently collapse by its own weight into a folded position independent of any mechanical interaction with an adjacent seat, riser or platform; and a second base mounted in spaced horizontal relationship to and adjacent one side of said first base, a second beam pivotally mounted to said second base and supporting one or more additional seats, said second beam being of like configuration to said first beam and joined longitudinally therewith, and jointly movable therewith by said lifting means whereby a plurality of seats are movable between said positions by a single lifting means, said first and second base comprising a bank of chairs operable by a single lifting means, said system comprising a plurality of banks, each bank having its own lifting means, the lifting means for each bank being interconnected serially whereby a series of banks can be operated by a single energy source for said lifting means.

45. The apparatus of claim 44 wherein said pneumatic lifting means includes a bellows.

46. In a collapsible seating system with automatically folding seats movable between a raised use position and a lowerered storage position, the improvement comprising, in combination:

(a) pneumatic lift means including a bellows which when first inflated lifts one or more of said seats into said use position;

(b) lock means which prevent said seats from being lowered upon deflation of said bellows after said first inflation;

(c) means for releasing said lock means after said bellows are inflated a second time, said one or more seats being lowered by their gravitational weight after said lock means are released, and said bellows are deflated a second time.

47. The improvement according to claim 46 wherein said one or more seats are lowered into said storage position at a controlled rate, said bellows having a preselected air discharge rate based on the gravitational weight of said seats.

48. In a telescoping seating system having a plurality of rows adapted for movement between a use position in which said rows are in stepped relation and a storage position in which said rows are generally vertically aligned with a lower row nested beneath an upper row, each row including a platform and seating means including a frame pivotally mounted to said platform for movement between a raised use position and a lowered storage position, said frame carrying a seat for at least one occupant, the improvement comprising, in combination:

lift means comprising a pneumatic bellows for raising and lowering said means between said raised and lowered position independent of any physical interaction with an adjacent row or platform, and independent of the movement of said rows between said use and storage positions.

* * * * *

UNITED STATES PATENT AND TRADEMARK OFFICE

CERTIFICATE OF CORRECTION

PATENT NO. : 4,850,159

DATED : July 25, 1989

INVENTOR(S) : John P. Conner

It is certified that error appears in the above-identified patent and that said Letters Patent is hereby corrected as shown below:

Column 4, line 4;

"19a" should be --19--.

Column 12, Claim 30, line 45;

"accurately" should be --arcuately--.

Column 12, Claim 30, line 47;

"generally" should be --general--.

Column 14, Claim 32, line 20;

"inn" should be --in--.

Column 14, Claim 34, line 56;

"arms" should be --arm--.

UNITED STATES PATENT AND TRADEMARK OFFICE

CERTIFICATE OF CORRECTION

PATENT NO. : 4,850,159

DATED : July 25, 1989

INVENTOR(S) : John P. Conner

It is certified that error appears in the above-identified patent and that said Letters Patent is hereby corrected as shown below:

Column 20, Claim 48, line 26:

After "said" (1st occurrence) insert --seating--.

Signed and Sealed this

Thirtieth Day of July, 1991

*Attest:*

*Attesting Officer*

HARRY F. MANBECK, JR.

*Commissioner of Patents and Trademarks*